US012601475B2

(12) United States Patent
Palonen

(10) Patent No.: US 12,601,475 B2
(45) Date of Patent: Apr. 14, 2026

(54) FLUIDIZED BED REACTOR SYSTEM AND A METHOD OF OPERATING A FLUIDIZED BED REACTOR SYSTEM

(71) Applicant: SUMITOMO SHI FW ENERGIA OY, Espoo (FI)

(72) Inventor: Juha Palonen, Varkaus (FI)

(73) Assignee: Sumitomo Shi FW Energia Oy, Espoo (FI)

( * ) Notice: Subject to any disclaimer, the term of this patent is extended or adjusted under 35 U.S.C. 154(b) by 724 days.

(21) Appl. No.: 17/919,964

(22) PCT Filed: Apr. 22, 2020

(86) PCT No.: PCT/EP2020/061160
§ 371 (c)(1),
(2) Date: Oct. 19, 2022

(87) PCT Pub. No.: WO2021/213643
PCT Pub. Date: Oct. 28, 2021

(65) Prior Publication Data
US 2023/0175687 A1 Jun. 8, 2023

(51) Int. Cl.
*F23C 10/00* (2006.01)
*F23B 10/00* (2011.01)
(Continued)

(52) U.S. Cl.
CPC ..... *F23C 10/005* (2013.01); *F23B 10/00* (2013.01); *F23C 6/02* (2013.01); *F23C 10/28* (2013.01);
(Continued)

(58) Field of Classification Search
None
See application file for complete search history.

(56) References Cited

U.S. PATENT DOCUMENTS 3,853,498 A 12/1974 Bailie
4,311,670 A 1/1982 Nieminen et al.
(Continued)

FOREIGN PATENT DOCUMENTS

JP 2003176486 A 6/2003
WO 2008071842 A1 6/2008
WO 2017142515 A1 8/2017

OTHER PUBLICATIONS

International Search Report and Written Opinion of the ISA for PCT/EP2020/061160, dated Jan. 12, 2021, 10 pages.
(Continued)

*Primary Examiner* — Brian R Gordon
(74) *Attorney, Agent, or Firm* — Venable LLP

(57) ABSTRACT

A reactor system and control method. The method includes feeding solid fuel and oxygen containing gas to a first fluidized bed reactor to form a fluidized bed of particles and combusting a first portion of the fuel in the bed with the oxygen containing gas to generate hot bed particles and a first stream of hot flue gas, conveying the first stream to the flue gas channel, transferring hot bed particles including a second portion of the solid fuel at a predetermined hot particles transfer rate from the first reactor to a second fluidized bed reactor, feeding fluidizing gas to the second reactor to form a second fluidized bed, and transferring bed particles from the second reactor to the first. The method includes first and second operation modes. In the first, the fluidizing gas is oxygen containing gas and, in the second, the gas includes steam, $CO_2$, or inert gas.

15 Claims, 3 Drawing Sheets

(51) Int. Cl.
*F23C 6/02* (2006.01)
*F23C 10/28* (2006.01)
*F23L 7/00* (2006.01)

(52) U.S. Cl.
CPC ..... *F23L 7/005* (2013.01); *F23C 2206/102* (2013.01)

(56) References Cited

U.S. PATENT DOCUMENTS 4,344,373 A 8/1982 Ishii et al.
4,674,560 A 6/1987 Marcellin
4,813,381 A 3/1989 Kullendorff et al.
4,823,712 A * 4/1989 Wormer ..... F23G 5/04 110/263
4,969,930 A * 11/1990 Arpalahti ..... C10J 3/482 48/210
5,010,830 A * 4/1991 Asuka ..... F22B 31/0053 122/4 D
5,014,652 A * 5/1991 Hyldgaard ..... F23C 10/005 122/483
5,078,100 A * 1/1992 Huschauer ..... F22B 31/0084 110/190
5,363,812 A 11/1994 Belin et al.
5,390,612 A * 2/1995 Toth ..... F23C 10/24 122/4 D
5,510,085 A * 4/1996 Abdulally ..... F23C 10/26 422/142
5,658,359 A * 8/1997 Berg ..... B01J 8/0055 122/2
5,784,975 A * 7/1998 Tanca ..... F23C 10/28 122/4 D
6,293,781 B1 * 9/2001 Hyppanen ..... F22B 31/0084 431/170
11,142,717 B2 * 10/2021 Vitse ..... B01D 53/12
11,859,812 B2 * 1/2024 Ström ..... C10J 3/723
2009/0242376 A1 * 10/2009 Lehto ..... F23C 10/04 201/31
2010/0101464 A1 * 4/2010 Leach ..... F23C 10/28 423/328.1
2010/0307389 A1 * 12/2010 Stewart ..... F01K 23/062 60/671
2012/0148961 A1 * 6/2012 Varonen ..... F23L 9/04 431/4
2013/0323654 A1 * 12/2013 Ruottu ..... F23C 10/28 431/170
2018/0180281 A1 * 6/2018 Andersson ..... F23C 10/18
2018/0347810 A1 * 12/2018 Chandran ..... B09B 3/00
2019/0093882 A1 * 3/2019 Hughes ..... F23L 7/00
2020/0141570 A1 * 5/2020 Ström ..... B01J 8/26
2020/0173734 A1 * 6/2020 Cuypers ..... F23C 99/00
2023/0057765 A1 * 2/2023 Leplat ..... C10G 9/005

OTHER PUBLICATIONS

Written Opinion of the International Preliminary Examining Authority for PCT/EP2020/061160, dated Jul. 6, 2021, 5 pages.
International Preliminary Report on Patentability for PCT/EP2020/061160, dated Jul. 29, 2022, 6 pages.
Examination Report issued on Oct. 11, 2023, in corresponding Australian Patent Application No. 2020443728 (3 pages).

* cited by examiner

FLUIDIZED BED REACTOR SYSTEM AND A METHOD OF OPERATING A FLUIDIZED BED REACTOR SYSTEM

BACKGROUND OF THE INVENTION

Field of the Invention

The present invention relates to a fluidized bed reactor system and a method of operating a fluidized bed reactor system. Thus, the invention relates to a reactor system comprising first and second fluidized bed reactors, such as a combustion reactor and a pyrolyzing or gasifying reactor.

Description of Related Art

Maintaining balance between consumed electricity and electricity fed into the grid has, for example, due to the increase of less controllable solar and wind power, led to stringent flexibility demands for combustion based power plants such as fluidized bed boilers. Corresponding stringent flexibility demands can also be given for fluidized bed reactors used for other purposes, such as for providing hot water or heat to an industrial process. The load, or heat output, of a fluidized bed combustion reactor, such as steam flow from a fluidized bed boiler, can generally be controlled by varying the rate of feeding fuel and oxygen containing combustion gas, usually, air, to the reactor. However, the heat capacity of a fluidized bed combustion reactor is generally relatively large, which slows down the changes of the burning rate and the heat output. Thus, there are many situations in which the load change rate or load control range of a fluidized bed combustion reactor that is obtainable by only varying the rate of feeding fuel and combustion air is not sufficient, and more versatile control methods and corresponding fluidized bed reactor systems are needed.

In a more advanced circulating fluidized bed reactor control method known, for example, from U.S. Pat. No. 4,813,381, the amount of bed particles in the furnace is changed so as to adjust heat absorption therein. U.S. Pat. Nos. 4,674,560 and 5,363,812 disclose control methods for a circulating fluidized bed reactor that are based on increasing or decreasing the amount of bed material that is collected to a bed material storage, whereby the bed density and the rate of heat recovery in the upper parts of the furnace can be varied.

U.S. Pat. Nos. 3,853,498, 4,311,670, 4,344,373 and published international patent application WO 2008/071842 disclose control methods of a fluidized bed pyrolyzing reactor that is combined with a fluidized bed combustion reactor, wherein the thermal energy required for the operation of a pyrolyzer is obtained by circulating therein a controlled amount of hot solids from the combustion reactor.

An object of the present invention is to provide a versatile fluidized bed reactor system and an advantageous method of operating the fluidized bed reactor system.

SUMMARY OF THE INVENTION

The above cited problems of the prior art are solved or at least minimized by the solutions defined in the appended independent claims. The dependent claims define advantageous embodiments of the present invention.

According to one aspect, the present invention provides a method of controlling a reactor system comprising first and second fluidized bed reactors, a flue gas channel in gas flow connection with the first fluidized bed reactor and a product gas channel in gas flow connection with the second fluidized bed reactor, the method comprising the steps of feeding solid fuel and oxygen containing gas to the first fluidized bed reactor so as to form therein a fluidized bed of particles and combusting a first portion of the solid fuel in the fluidized bed of particles with the oxygen containing gas so as to generate hot bed particles and a first stream of hot flue gas, conveying the first stream of hot flue gas to the flue gas channel, transferring hot bed particles including a second portion of the solid fuel at a predetermined hot particles transfer rate from the first fluidized bed reactor to the second fluidized bed reactor, feeding fluidizing gas to the second fluidized bed reactor so as to form therein a second fluidized bed of particles, and transferring bed particles from the second fluidized bed reactor to the first fluidized bed reactor, wherein the method comprises first and second operation modes, in which first operation mode the fluidizing gas is oxygen containing gas and the method comprises the steps of combusting a portion of the second portion of the solid fuel in the second fluidized bed of particles so as to generate a second stream of hot flue gas, and conveying the second stream of hot flue gas to the flue gas channel, and, in the second operation mode, the fluidizing gas comprises steam, $CO_2$ or non-oxygen containing inert gas, and the method comprises the steps of pyrolyzing or gasifying a portion of the second portion of the solid fuel in the second fluidized bed of particles so as to generate product gas, and conveying the product gas to the product gas channel.

As defined above, the reactor system, comprising first and second fluidized bed reactors, is used in one of two different operation modes. Solid fuel and oxygen containing gas, usually air, are in operation always, i.e., in both first and second operation modes, fed to the first fluidized bed reactor. Therefore, solid fuel is always in operation burned in the first fluidized bed reactor, which can thus be called a combustion reactor, or a first combustion reactor. At least a portion of the oxygen containing gas is fed to the first fluidized bed reactor through a bottom grid so as to fluidize solid particles, comprising fuel particles and inert bed particles, such as sand or ash particles, in the reactor. Thereby, a portion of the solid fuel, so-called a first portion of the solid fuel, is combusted in the first fluidized bed reactor.

By the combustion of the solid fuel in first fluidized bed reactor are generated hot bed particles and a stream of flue gas, so-called a first stream of hot flue gas. A portion of the hot bed particles, including non-combusted solid fuel particles, is then transferred at a controlled rate, so-called a hot particles transfer rate, from the first fluidized bed reactor to the second fluidized bed reactor. Temperature of the hot bed particles transferred to the second fluidized bed reactor generally corresponds to that of the bed particles in the first fluidized bed reactor, being usually at least 700° C.

Fluidizing gas, the composition of which depends on the operation mode, is generally fed to the second fluidized bed reactor through a bottom grid so as to form therein a second fluidized bed of particles. A stream of solid particles, comprising mainly ash, is generally discharged from the reactor system at one or more suitable portions of the system, for example, from the bottom of the combustion reactor. A particle transfer loop within the reactor system is completed by transferring bed particles from the second fluidized bed reactor back to the first fluidized bed reactor. Transfer of particles between the first and second fluidized bed reactors may, depending on the reactor system in question, be realized by any of several generally known methods, such as gravitationally, mechanically, or pneumatically.

Each of the first and second fluidized bed reactors is advantageously a circulating fluidized bed reactor. Thereby, the transfer of particles may advantageously be performed by directing a portion of solid particles separated in a particle separator from the exhaust gas of a reactor to the other reactor. According to a preferred embodiment of the present invention, the second fluidized bed reactor is a circulating fluidized bed reactor and particles are transferred from its particle separator to the first fluidized bed reactor, whereas particles transferred in the opposite direction, to the second fluidized bed reactor, are taken from the lower portion of the first fluidized bed reactor. A reason for this is that usually solid particles taken from the lower portion of a combustion reactor comprise more non-combusted fuel particles than solid particles separated from the exhaust gas. Such non-combusted fuel particles are utilized, in both operation modes, in the second fluidized bed reactor.

According to the present invention, fluidizing gas fed in the first operation mode to the second fluidized bed reactor is oxygen containing gas, advantageously the same oxygen containing gas, usually air, as fed to the first fluidized bed reactor. Solid fuel, comprising, or consisting of, non-combusted solid fuel transferred from the first fluidized bed reactor, is thereby combusted in the second fluidized bed of particles. The second fluidized bed reactor is thus, for reasons to be explained, maintained in the first operation mode at a relatively high temperature. Especially when the amount of non-combusted solid fuel transferred from the first fluidized bed reactor to the second fluidized bed reactor is small, for example, due to high reactivity of the fuel, it may be useful to feed also auxiliary solid fuel directly to the second fluidized bed reactor. Generally, the second fluidized bed reactor can in the first operation mode be maintained at the desired relatively high temperature either by controlling the particle transfer rate to a suitable level or by controlling the feed rate of the auxiliary fuel.

The second fluidized bed reactor operates in the first operation mode as a second combustion reactor that acts parallel to the first combustion reactor. More specifically, combustion of solid fuel in the second fluidized bed reactor generates flue gas, so-called a second stream of hot flue gas, that is advantageously also conveyed to the flue gas channel, and is therein combined with the first stream of hot flue gas. Bed particles, which thus stay hot in the second fluidized bed reactor, are circulated back to the first fluidized bed reactor.

The flue gas channel advantageously comprises conventional heat recovery means, such as air preheaters, economizers, evaporators, and superheaters. The flue gases are then advantageously cooled, and the energy is nearly completely recovered, in a conventional water/steam circuit. The walls enclosing the furnace of the second fluidized bed reactor are preferably covered with a relatively thick layer of refractory, whereby the reactor can be maintained at a desired temperature without any significant heat losses. Thus, the heat output or the steam production rate of the reactor system according to the present invention is in the first operation mode at least nearly the same as it would be if all the fuel would be combusted in a single reactor.

When the reactor system is switched from the first operation mode to the second operation mode, the fluidizing gas fed to the second fluidized bed reactor is changed from the original oxygen containing gas to a gas comprising steam, $CO_2$ or non-oxygen containing inert gas, which causes solid fuel to be pyrolyzed or gasified in the second fluidized bed reactor. Thus, in the second operation mode, the second fluidized bed reactor utilizes hot bed particles conveyed from the first fluidized bed reactor and operates as a pyrolyzer or as an indirect gasifier.

As explained above, the solid fuel pyrolyzed or gasified in the second operation mode in the second fluidized bed reactor comprises the second portion of solid fuel originally fed to the first fluidized bed reactor. Moreover, it is possible, even in the second operation mode, to feed auxiliary solid fuel directly to the second fluidized bed reactor. Pyrolyzing or gasifying solid fuel in the second fluidized bed reactor generates product gas that is conveyed to the product gas channel. The product gas is then directed to any conventional use, for example, via a cooling stage into a synthesis process treatment.

Switching the reactor system from the first operation mode to the second operation mode is advantageously performed in order to efficiently ramp down the first fluidized bed reactor, i.e., to rapidly and/or to a large extend decrease the load or heat output of the combustion reactor. Decrease of the heat output is partly based on not anymore conveying flue gas from the second fluidized bed reactor to the flue gas channel. Also, because the process taking place in the second fluidized bed reactor is changed from an exothermic combustion process to an endothermic pyrolysis or a gasification process, the temperature in the second fluidized bed reactor inevitably decreases. Thus, the temperature of the solid particles returned from the second fluidized bed reactor to the first fluidized reactor is lower in the second operation mode than in the first operation mode, whereby the heat output from the combustion reactor tends to decrease. According to a preferred embodiment of the present invention, the temperature of the bed particles transferred from the second fluidized bed reactor to the first fluidized bed reactor is in the second operation mode at least 20° C. lower than in the first operation mode.

The predetermined hot particles transfer rate and the rate of feeding fluidizing gas to the second fluidized bed reactor are advantageously in the first operation mode controlled so as to maintain the second fluidized bed reactor in a predetermined relatively high temperature, preferably, in a temperature of at least, for example, 600° C., or even more preferably, in a temperature of at least 400° C. Maintaining the second fluidized bed reactor in the first operation mode at such a high temperature is useful for being able to very rapidly start the second operation mode, i.e., gasifying or pyrolyzing solid fuel.

Both gasifier and pyrolyzer reactors are typically of a refractory lined design, with a limited heat up rate (50 to 70° C./h) of the refractories, whereby their start-up time from ambient temperature is typically 15 to 20 hours. When operating as a stand-alone unit this slow heat up phase is generally not a problem. However, if the gasifier or pyrolyzer is connected to a fluidized bed boiler to be used for assisting in the boiler load changes, the slow heat up rate is not allowable. According to the present invention, the second operation mode of the second fluidized bed reactor can be started much faster than what would have been possible by starting to transfer solid fuel from the combustion reactor to the second reactor maintained, for example, at ambient temperature. Thus, the present invention renders it possible to achieve a very fast ramp down rate of the heat output of the combustion process in the reactor system, for example, to compensate for power variations in the grid due to changing solar and wind power.

As a further aspect, the present invention provides a method of rapid ramp up of the combustion system by switching of the reactor system from the second operation mode to the first operation, which process can advantageously be further enhanced by firing compressed product gas in the first fluidized bed reactor or in a separate superheater chamber of the first fluidized bed reactor.

Another main aspect or advantage of the present invention is that it renders possible to lower the minimum load of the fluidized bed reactor, more particularly, of the first fluidized bed reactor. A reason for this is that transferring hot solid particles from the first fluidized bed reactor to the second fluidized bed reactor, and returning particles at a lower temperature back to the first fluidized bed reactor, due to using heat of the solids in the pyrolyzing or gasification process in the second fluidized bed reactor, leads to decreased heat output from the first fluidized bed reactor.

The hot particles transfer rate from the first fluidized bed reactor to the second fluidized bed reactor is preferably in the second operation mode controlled so as to maintain the second fluidized bed reactor at least at a predefined pyrolyzing or gasifying temperature, which temperature is preferably at least 500° C., or even more preferably at least 400° C. In order to enhance the load change rate of the combustion reactor, the predetermined hot particles transfer rate, i.e., particle transfer rate from the first fluidized bed reactor to the second fluidized bed reactor, is advantageously in the second operation mode at least 30% higher than in the first operation mode.

The load change rate of the combustion reactor may advantageously also be enhanced by having the transfer rate of hot bed particles both from the first fluidized bed reactor to the second fluidized bed reactor and that of bed particles from the second fluidized bed reactor to the first fluidized bed reactor controlled so that the bed inventory, i.e., the amount of bed particles, in the first fluidized bed reactor is, in the second operation mode, smaller than that in the first operation mode. Thus, the above described embodiment of the present invention corresponds to that described in patent documents U.S. Pat. Nos. 4,674,560 and 5,363,812 in that load of a combustion reactor is varied by collecting a controlled amount of bed material from the combustion reactor to a separate vessel. However, the method according to the present invention differs from that described in the U.S. Pat. Nos. 4,674,560 and 5,363,812 in that the material collecting vessel is not just a storage, but a product gas generating pyrolyzing or gasifying reactor, which gives rise to generation of useful product gas and to efficient cooling of the collected material.

According to another aspect, the present invention provides a fluidized bed reactor system comprising first and second fluidized bed reactors, means for feeding solid fuel and oxygen containing gas to the first fluidized bed reactor, a flue gas channel in gas flow connection with the first fluidized bed reactor, means for transferring bed particles from the first fluidized bed reactor to the second fluidized bed reactor, means for feeding fluidizing gas to the second fluidized bed reactor, and means for transferring bed particles from the second fluidized bed reactor to the first fluidized bed reactor, wherein the means for feeding fluidizing gas is in controllable fluidizing gas flow connection with the means for feeding combustion oxygen containing gas and with a means for feeding steam, $CO_2$ or non-oxygen containing inert gas. The second fluidized bed reactor is in controllable exhaust gas flow connection with the flue gas channel and with a product gas channel.

The above brief description, as well as further objects, features, and advantages of the present invention will be more fully appreciated by reference to the following detailed description of the presently preferred, but nonetheless illustrative, embodiments in accordance with the present invention, when taken in conjunction with the accompanying drawings.

DETAILED DESCRIPTION OF THE INVENTION

Figure 1:
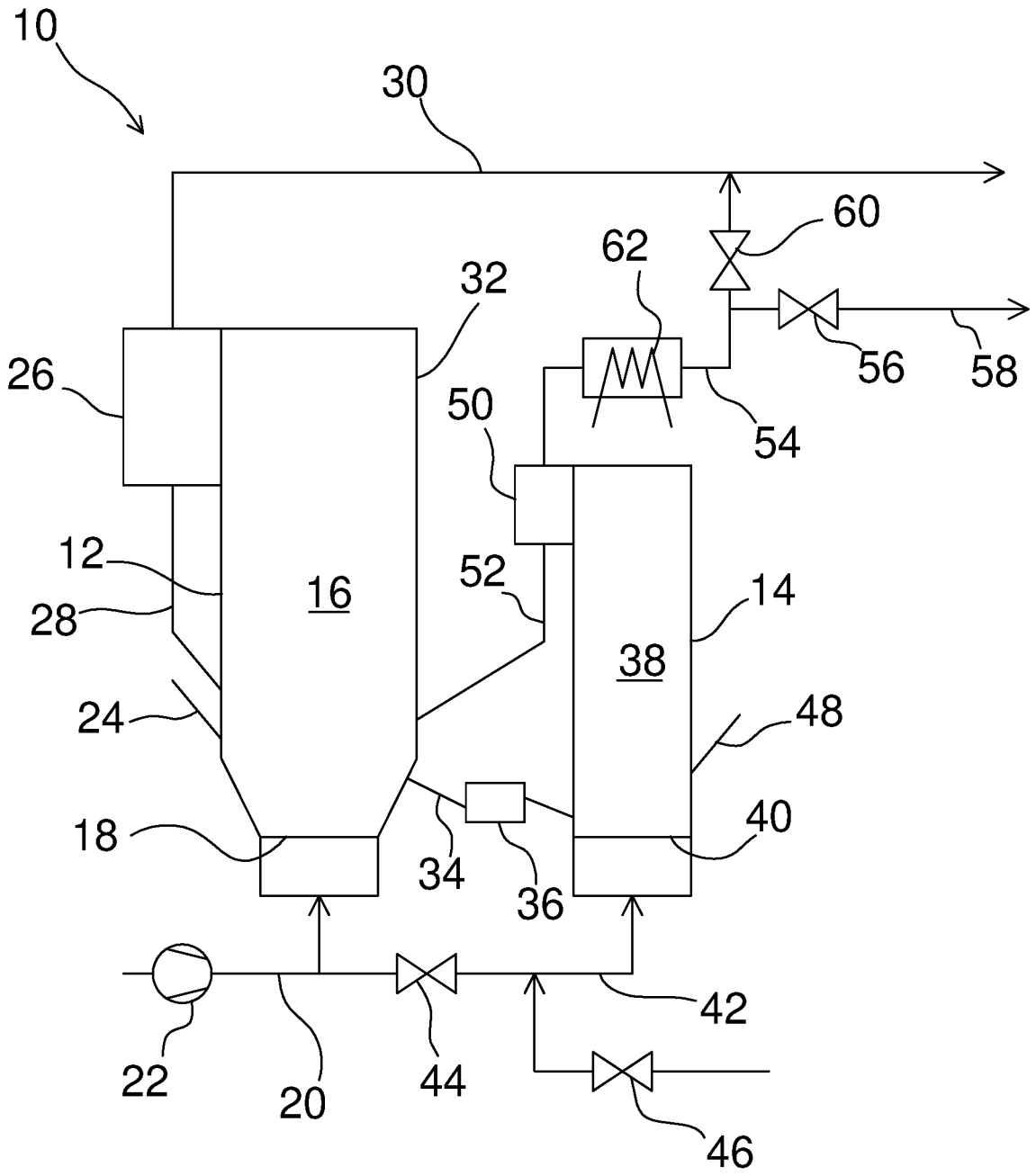
FIG. 1 schematically illustrates an arrangement according to a first preferred embodiment of the present invention.

The diagram of FIG. 1 schematically illustrates a fluidized bed reactor system 10 according to a preferred embodiment of the present invention. The reactor system comprises a first fluidized bed reactor 12 and a second fluidized bed reactor 14. In the embodiment shown in FIG. 1, both first and second fluidized bed reactors are circulating fluidized bed reactors, but alternatively either one or both of the reactors could be another kind of fluidized bed reactor, such as a bubbling bed reactor.

The first fluidized bed reactor 12 is a steam generator, i.e., a boiler, and comprises a furnace 16 with a bottom grid 18 connected by an air channel 20 to an air supply 22, i.e., to an air feeding fan, means for feeding solid fuel 24, a particle separator 26 connected to the upper portion of the furnace, a return duct 28 for returning particles separated in the particle separator 26 to the lower portion of the furnace, and a flue gas channel 30 for conveying cleaned flue gas from the particle separator 26 to a back pass. The return duct 28 also advantageously comprises a conventional gas-lock (not shown in FIG. 1).

Walls 32 enclosing the furnace 16 of the first fluidized bed reactor 12 are of conventional evaporative tube-wall construction and the back pass comprises conventional heat recovery devices, such as an air preheater, economizers and superheaters, and flue gas cleaning devices, such as a fly ash collector and a wet or dry flue gas desulfurizer. Because such devices are well-known to persons skilled in the art and not specifically relevant for the present invention, they are not shown in FIG. 1 or described here in more detail. The furnace 16 of the first fluidized bed reactor 12 advantageously comprises conventional means for discharging bottom ash (not shown in FIG. 1) from the bottom portion of the furnace.

To the lower portion of the furnace 16 of the first fluidized bed reactor 12 is connected a particle transfer channel 34 equipped with a gas-lock forming particle flow controller 36, such as a fluidized bed, mechanical or pneumatic flow controller, for conveying hot bed particles at a controlled rate from the furnace 16 of the first fluidized bed reactor 12 to a furnace 38 of the second fluidized bed reactor 14. The furnace 38 of the second fluidized bed reactor comprises a bottom grid 40, which is connected via a fluidizing gas channel 42 and a valve 44 to the air channel 20 of the first fluidized bed reactor 12, and also via a valve 46 to a steam supply (not shown in FIG. 1). The furnace 38 of the second fluidized bed reactor 14 is also equipped with means for feeding solid fuel 48, and a particle separator 50 connected to the upper portion of the furnace of the second fluidized bed reactor 14. Walls enclosing the furnace 38 of the second fluidized bed reactor 14 are preferably covered with a relatively thick layer of refractory.

The lower portion of the particle separator 50 of the second fluidized bed reactor 14 is connected via a second particle transfer channel 52 to the furnace 16 of the first fluidized bed reactor 12 for returning particles separated in the particle separator of the second fluidized bed reactor to the first fluidized bed reactor. The particle separator 50 of the second fluidized bed reactor 14 may also be equipped with a return duct (not shown in FIG. 1), similarly as the return duct 28 of the particle separator 26 of the first fluidized bed reactor 12, for returning a portion of the separated particles to the lower portion of the furnace 38 of the second fluidized bed furnace 14. The particle transfer channel 52 and/or the return duct (not shown in FIG. 1) of the particle separator 50 of the second fluidized bed reactor 14 is advantageously equipped with means for controlling (not shown in FIG. 1) the shares of particles that are returned to the furnace 38 of the second fluidized bed reactor 14 and particles that are transferred to the furnace 16 of the first fluidized bed reactor 12, respectively. The second particle transfer channel 52, and/or the return duct (not shown in FIG. 1) of the particle separator 50 of the second fluidized bed reactor 14, may thus be equipped with a particle flow controller (not shown in FIG. 1), such as a fluidized bed, mechanical or pneumatic flow controller, for conveying separated particles at a controlled rate into the furnace/s. The second particle transfer channel 52, as well as the return channel (not shown in FIG. 1) of the particle separator 50 of the second fluidized bed reactor 14, advantageously also comprises a gas-lock (not shown in FIG. 1), preferably, as a part of the above described particle flow controller, to prevent gas flow from the furnace/s to the particle separator 50.

The upper portion of the particle separator 50 is connected to an exhaust gas channel 54 that is, via a valve 56, connected to a product gas channel 58 and via another valve 60 to the flue gas channel 30. The product gas channel generally comprises product gas cooling surfaces, such as heat transfer surfaces 62 as shown in FIG. 1, in the exhaust gas channel 54, and leads to conventional means for utilizing the product gas, such as devices for synthesis process treatment (not shown in FIG. 1).

The fluidized bed reactor system is advantageously operated in one of first and second operating modes, wherein the furnace 16 of the first fluidized bed reactor 12 is always in operation operated as a circulating fluidized bed boiler that is in a relatively small flow solids circulation with the furnace 38 of the second fluidized bed reactor 14, which solids flow circulation is controlled by the particle flow controller 36 in the particle transfer channel 34.

In the first operation mode, the valve 44 between the air channel 20 and the fluidizing gas channel 42 is open and both first and second fluidized bed reactors, 12, 14, are fluidized with air. Thereby, both fluidized bed reactors operate as a combustion reactor. The valve 46 is closed so that steam is not supplied from the steam supply into the fluidizing gas channel 42. In the first operation mode, also, the valve 60 between the exhaust gas channel 54 and flue gas channel 30 is open, whereby flue gas from combustion processes in the both fluidized bed reactors 12, 14 are conveyed to the flue gas channel 30. Respectively, the valve 56 to the product gas channel 58 is closed. At least a portion of particles separated in the particle separator 50 of the second fluidized bed reactor 14 are returned via the second particle transfer channel 52 to the furnace 16 of the first fluidized bed reactor 12.

The purpose of the first operating mode is to generate steam with a good efficiency and to keep the furnace 38 of the second fluidized bed reactor 14 in a temperature that enables its rapid switching to a pyrolyzing or gasification mode. The desired temperature is achieved by controlling the rate of transferring hot solids from the furnace 16 of the first fluidized bed reactor by the particle flow controller 36 and/or by feeding auxiliary fuel to the furnace 38 of the second fluidized bed reactor 14 by the solid fuel feeder 48. When rapid ramp down of the combustion process in the reactor system 10 is needed, the rate of transferring hot solids from the first fluidized bed reactor 12 to the second fluidized bed reactor 14 is increased and the second fluidized bed reactor is shifted to a gasifier or pyrolyzing mode by closing the valve 44 and opening the valve 46 to fluidize the fluidized bed in the furnace 38 with steam. In the gasifying or pyrolyzing mode of the second fluidizing reactor 38, the valve 60 to the flue gas channel 30 is closed and the valve 56 to the product gas channel 58 is opened so as to convey the generated product gas to other use. Auxiliary fuel is generally in the gasifying or pyrolyzing mode fed via the fuel feeder 48 to the furnace 38 of the second fluidized bed reactor 14.

Above is described an embodiment in which the fluidizing gas of the first fluidized bed reactor is air, but, in other embodiments of the present invention, the fluidizing gas can alternatively be other oxygen containing gas, such as a mixture of oxygen and CO2 rich gas. In the above described embodiment, the first fluidized bed reactor is a boiler, but, in other embodiments of the present invention, the first fluidized bed reactor can alternatively be another fluidized bed reactor, such as an incinerator generating steam or hot water to another use. Above is described an embodiment in which the second fluidized bed reactor is in the second operating mode fluidized with steam, but, in other embodiments of the present invention, the second fluidized bed reactor can, in the second operating mode, be fluidized with another gasifying or pyrolyzing inducing gas, such as $CO_2$ or non-oxygen containing inert gas, or with a mixture of such gases.

Figure 2:
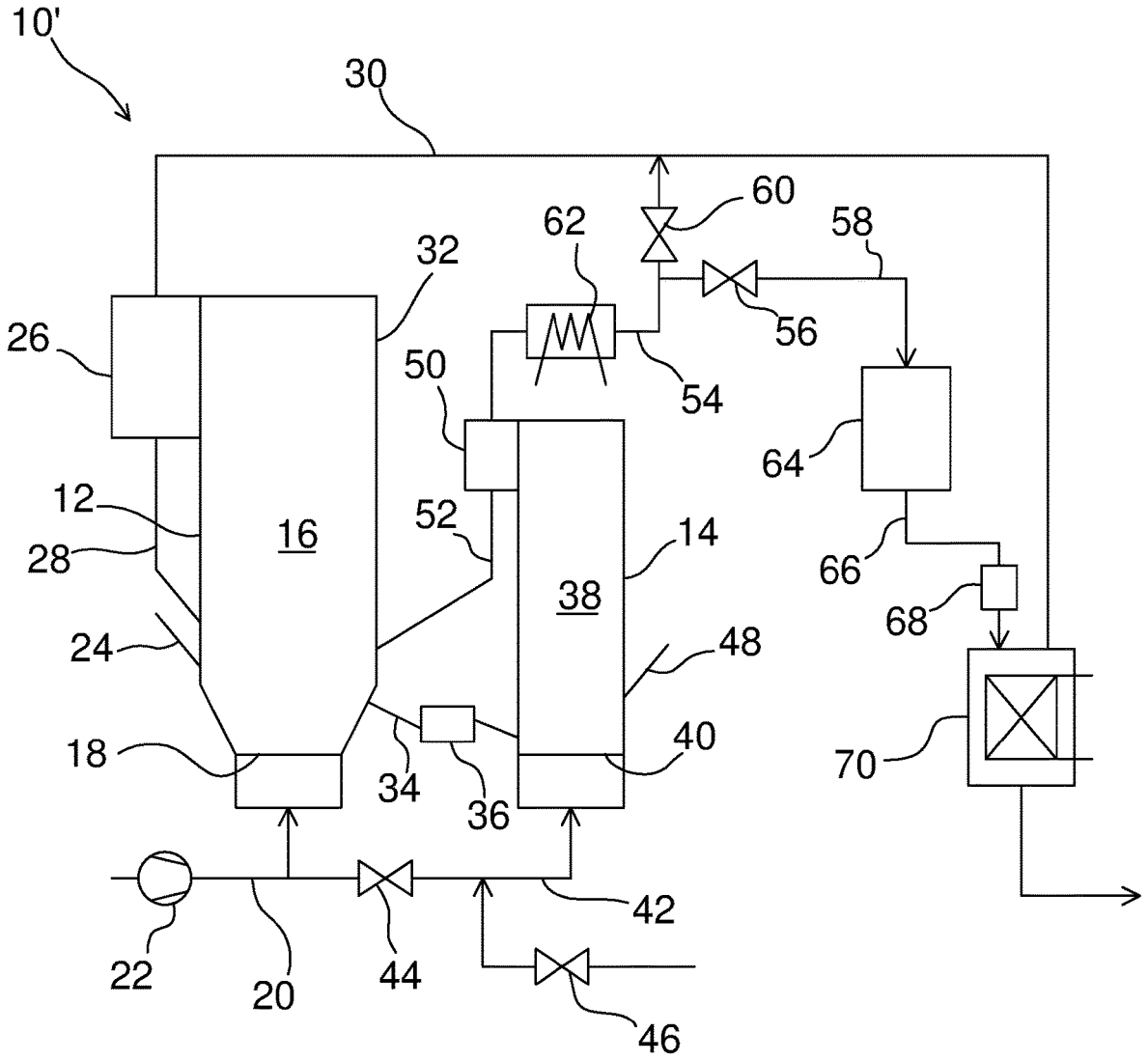
FIG. 2 schematically illustrates an arrangement according to a second preferred embodiment of the present invention.

The diagram of FIG. 2 schematically illustrates a fluidized bed reactor system 10' according to another preferred embodiment of the present invention. The embodiment shown in FIG. 2 differs from that shown in FIG. 1 mainly in that product gas produced in the second operation mode in the second fluidized bed reactor 14 is conveyed via the channel 58 to a product gas storage 64. The product gas storage is advantageously associated with means (not shown in FIG. 2) for compressing the product gas. The product gas storage 64 is according to the embodiment shown in FIG. 2 connected via a channel 66 to a burner 68 arranged to produce and to convey hot gas to a superheater chamber 70 arranged in the flue gas channel 30 of the first fluidized bed reactor 12. While the reactor system and the method of controlling a reactor system described in connection with FIG. 1 are directed to enable especially rapid ramp down of a combustion process, by switching from the first operation mode to the second operation mode, the arrangement shown in FIG. 2 is directed to also enable rapid ramp up of the combustion process.

Rapid ramp up of the combustion process is advantageously realized by switching from the second operation mode to the first operation mode and by simultaneously firing by the burner 68 product gas collected during the second operation mode in the product gas storage 64 so as to rapidly increase superheating of steam in the superheater chamber 70. Alternatively, product gas collected to the product gas chamber 64 can be fired at any time, during either a first or a second operation mode, when rapid increase of the heat output of the boiler is desired.

Figure 3:
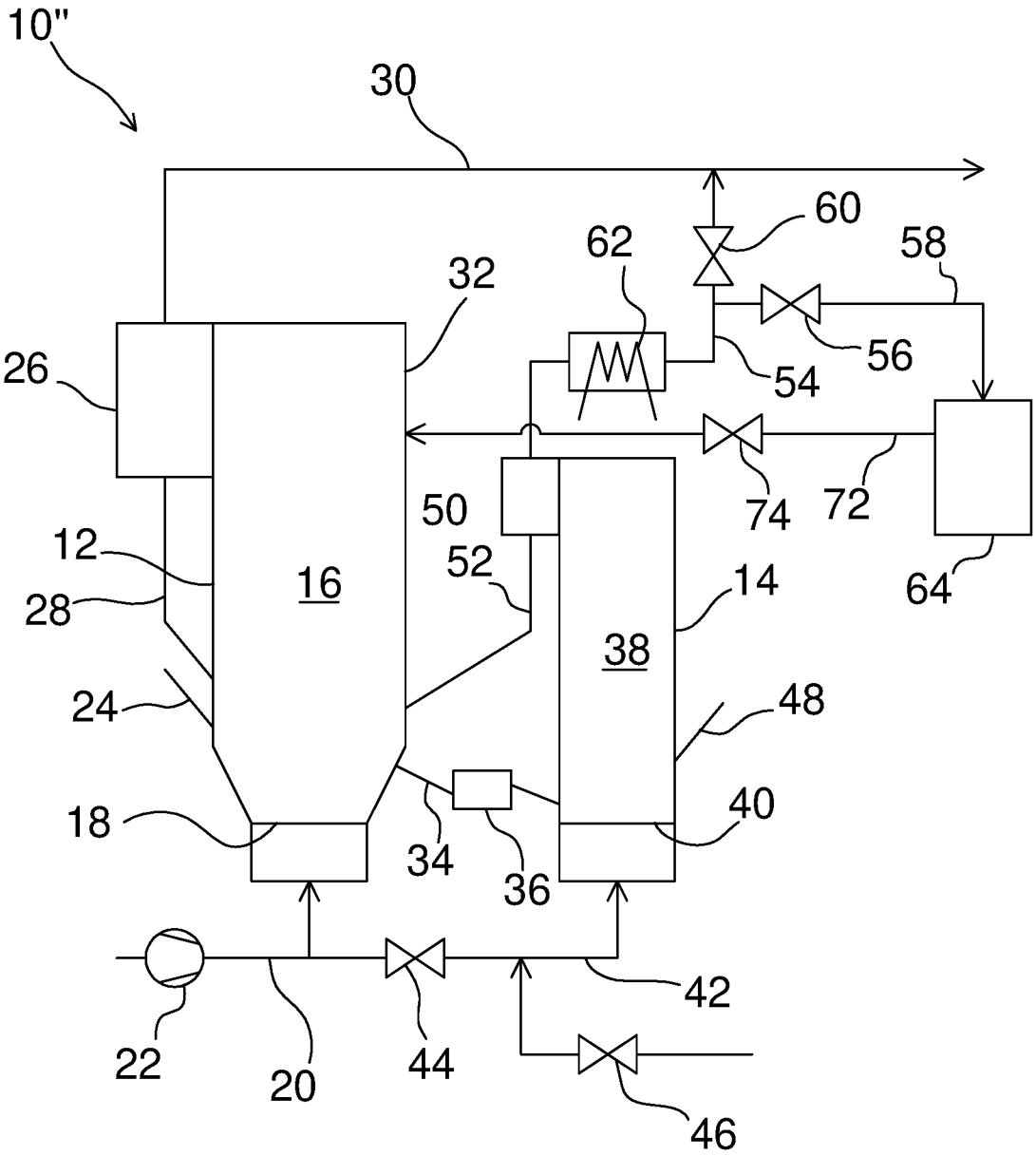
FIG. 3 schematically illustrates an arrangement according to a third preferred embodiment of the present invention.

The diagram of FIG. 3 schematically illustrates a fluidized bed reactor system 10" according to still another preferred embodiment of the present invention. The embodiment shown in FIG. 3 differs from that shown in FIG. 2 in that product gas collected in the product gas storage 64 is not conveyed to a superheater chamber 70, but via a channel 72 with a valve 74 to the furnace 16 of the first fluidized bed reactor 12. Thereby, product gas collected in the product gas storage 64 can be used, when desired, to rapidly increase temperature in the furnace 16 of the first fluidized bed actor 12 to increase the heat output of the first fluidized bed reactor.

Alternatively, in FIGS. 2 and 3, the product gas channel 58 can be divided in two branches, one directed into the product gas storage 64 and the other into the product gas upgrading such as leading to conventional means for utilizing the product gas, such as devices for synthesis process treatment (not shown in FIGS. 2 and 3). It is also possible to combine any of the embodiments described above into one, as technically feasible.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

The invention claimed is:

1. A method of controlling a reactor system comprising first and second fluidized bed reactors, a flue gas channel in gas flow connection with the first fluidized bed reactor and a product gas channel in gas flow connection with the second fluidized bed reactor, the method comprising the steps of:

feeding solid fuel and oxygen containing gas to the first fluidized bed reactor so as to form therein a fluidized bed of particles and combusting a first portion of the solid fuel in the fluidized bed of particles with the oxygen containing gas so as to generate heated bed particles and a first stream of flue gas;

conveying the first stream of flue gas to the flue gas channel;

transferring heated bed particles including a second portion of the solid fuel at a predetermined heated particles transfer rate from the first fluidized bed reactor to the second fluidized bed reactor;

feeding fluidizing gas to the second fluidized bed reactor so as to form therein a second fluidized bed of particles; and transferring bed particles from the second fluidized bed reactor to the first fluidized bed reactor, wherein the method comprises first and second operation modes, in which first operation mode the fluidizing gas is oxygen containing gas and the method comprises the steps of:

combusting a portion of the second portion of the solid fuel in the second fluidized bed of particles so as to generate a second stream of flue gas; and conveying the second stream of flue gas to the flue gas channel, and, in which second operation mode the fluidizing gas comprises steam, $CO_2$, or non-oxygen containing inert gas and the method comprises the steps of:

pyrolyzing or gasifying a portion of the second portion of the solid fuel in the second fluidized bed of particles so as to generate product gas; and conveying the product gas to the product gas channel.

2. The method of controlling a reactor system according to claim 1, wherein the first fluidized bed reactor is ramped down by switching the reactor system from the first operation mode to the second operation mode.

3. The method of controlling a reactor system according to claim 2, wherein the predetermined heated particles transfer rate in the second operation mode is at least 20% higher than that in the first operation mode.

4. The method of controlling a reactor system according to claim 1, wherein, in the first operation mode, the predetermined heated particles transfer rate and a rate of feeding fluidizing gas are controlled so as to maintain the second fluidized bed reactor at least at a predefined temperature.

5. The method of controlling a reactor system according to claim 4, wherein the predefined temperature is at least 400° C.

6. The method of controlling a reactor system according to claim 1, wherein the predetermined heated particles transfer rate in the second operation mode is controlled so as to maintain the second fluidized bed reactor at least at a predefined pyrolyzing temperature or a predefined gasifying temperature.

7. The method of controlling a reactor system according to claim 6, wherein the predefined pyrolyzing temperature or the predefined gasifying temperature is at least 400° C.

8. The method of controlling a reactor system according to claim 1, wherein the second operation mode comprises a step of feeding additional solid fuel to the second fluidized bed reactor.

9. A fluidized bed reactor system comprising: first and second fluidized bed reactors;

a fuel feed configured for feeding solid fuel and an oxidant feed for feeding oxygen containing gas to the first fluidized bed reactor;

a flue gas channel in gas flow connection with the first fluidized bed reactor;

a first transfer line configured for transferring bed particles from the first fluidized bed reactor to the second fluidized bed reactor;

a fluidizing gas feed configured for feeding fluidizing gas to the second fluidized bed reactor;

a second transfer line configured for transferring bed particles from the second fluidized bed reactor to the first fluidized bed reactor;

a gas supply configured for supplying at least one of steam, CO2, and non-oxygen containing inert gas;

an exhaust gas channel connected to the second fluidized bed reactor; and a product gas channel configured to receive product gas generated in and conveyed from the second fluidized bed reactor, wherein the fluidizing gas feed to the second fluidized bed reactor is in selective gas flow connection with the oxidant feed and with the gas supply, and the exhaust gas channel is in selective flow connection with the flue gas channel and with the product gas channel.

10. The fluidized bed reactor system according to claim 9, wherein the first transfer line comprises a particle flow controller.

11. The fluidized bed reactor system according to claim 10, wherein the particle flow controller is a mechanical flow controller or a pneumatic flow controller, or comprises a fluidized bed.

12. The fluidized bed reactor system according to claim 11, wherein the fluidizing gas feed comprises a channel provided with a valve to supply oxygen containing gas and a channel provided with a valve to supply steam, $CO_2$, or non-oxygen containing inert gas.

13. The fluidized bed reactor system according to claim 9, wherein the selective exhaust gas flow connection comprises a channel provided with a valve connected to the flue gas channel and a channel provided with a valve connected to the product gas channel.

14. The fluidized bed reactor system according to claim 9, further comprising a product gas storage in gas flow connection with the product gas channel, a superheater chamber arranged in the flue gas channel and a burner in gas flow connection with the product gas storage and arranged to produce and to convey heated gas to the superheater chamber.

15. The fluidized bed reactor system according to claim 9, further comprising a product gas storage that is in gas flow connection with the product gas channel and with the first fluidized bed reactor.

* * * * *